United States Patent [19]

Douglas

[11] 4,058,055

[45] Nov. 15, 1977

[54] APPARATUS FOR APPLYING TRANSFERS TO FABRICS

[76] Inventor: Leon L. Douglas, 407 Lakeside Road, Wynnewood, Pa. 19096

[21] Appl. No.: 602,072

[22] Filed: Aug. 5, 1975

[51] Int. Cl.[2] ..... B44B 5/00

[52] U.S. Cl. ..... 101/10; 101/27; 101/DIG. 4; 428/914

[58] Field of Search ..... 101/9, 10, 11, 21, 25, 101/27, 31, DIG. 4, 114, 126, 269, 297; 428/914; 34/53

[56] References Cited

U.S. PATENT DOCUMENTS

| | | | |
|---|---|---|---|
| 703,026 | 6/1902 | Waldmann et al. | 101/10 |
| 811,071 | 1/1906 | Liberman | 101/10 |
| 1,042,014 | 10/1912 | Lindeman | 101/10 |
| 1,129,279 | 2/1915 | Donner | 101/21 |
| 1,727,416 | 9/1929 | Smith | 101/DIG. 4 |
| 2,039,072 | 4/1936 | Dugdale | 101/269 |
| 2,356,951 | 8/1944 | Runton | 101/27 X |
| 2,722,038 | 11/1955 | Freund | 101/31 X |
| 2,776,509 | 1/1957 | Kienel | 101/27 X |
| 3,128,692 | 4/1964 | Talarico | 101/11 |
| 3,161,543 | 12/1964 | Borders et al. | 101/126 |
| 3,198,168 | 8/1965 | Grupe | 101/27 X |
| 3,358,747 | 12/1967 | Lesher et al. | 34/53 X |
| 3,465,627 | 9/1969 | Vigneault | 101/30 X |
| 3,774,529 | 11/1973 | Filsinger et al. | 101/27 |
| 3,881,410 | 5/1975 | Shenola | 101/297 X |

*Primary Examiner*—Louis G. Mancene
*Assistant Examiner*—Paul J. Hirsch
*Attorney, Agent, or Firm*—Robert S. Lipton

[57] ABSTRACT

An apparatus is disclosed which is particularly designed for applying transfers or appliques comprised of thermosetting inks to garments such as T-shirts and sweat shirts. The apparatus includes an upper and lower platen for applying heat and pressure. The upper platen includes heating elements and a temperature control mechanism to heat it to a particular desired temperature. The apparatus is designed so that the pressure between the two platens is uniform and of the proper magnitude. The apparatus is also designed so that when the garment and transfer have been subjected to the appropriate amount of pressure and heat for a desired amount of time, the platens automatically disengage. Upon disengaging, a timer which is included in the apparatus automatically resets itself to the originally selected time period.

10 Claims, 8 Drawing Figures

APPARATUS FOR APPLYING TRANSFERS TO FABRICS

BACKGROUND OF THE INVENTION

This invention relates generally to apparatus for applying transfers or designs to garments particularly in retail outlets. Garments such as T-shirts and sweat shirts are commonly available with various designs, emblems or letters located thereon. Such garments have become increasingly popular. This popularity has been sufficient to result in a great demand for a wide variety of designs. In order to satisfy this demand for variety it has become common for retail outlets to sell the designs and garments separately. The retailer then applies the design to the garment. This enables the retailer to provide a wide variety of designs without the necessity of stocking the extensive and costly inventory of garments which would otherwise be necessary to provide such variety.

The apparatus of the present invention is a heat transfer machine particularly designed to apply transfers to various garments. The apparatus is designed to be used in combination with transfers of the type which are comprised of a design in thermosetting ink or inks positioned on a carrier material. The mirror image of the desired design is placed on the carrier so that when the design is transferred to the garment, the desired design is achieved. In applying such transfers to garments, the transfer is placed adjacent to the garment. They are then compressed together while applying heat. When heated, the thermosetting inks of which the design is comprised leave the carrier and flow into the fibers of the fabric. Once set the inks become permanently affixed to the fabric, notwithstanding subsequent applications of heat.

Many different types of heat transfer machines, such as presses and the like, which are well-known in the prior art, have been used for this purpose. Most of them have had one deficiency or another. Many of the existing presses lack the requisite amount of pressure between their platens. Additionally, it has been difficult to adjust the magnitude of the pressure of some of these presses. Many of the prior art devices do not operate at the requisite temperature resulting in a design which easily becomes disconnected from the garment. Other presses, although they may apply the requisite amount of heat and pressure, provide no means for applying that heat and pressure the requisite amount of time.

When the requisite temperature and pressure have been exerted upon the transfer and garment for the proper amount of time, the platens must be carefully disengaged so as to prevent smearing or lifting of the thermosetting inks prior to their setting.

SUMMARY OF THE INVENTION

Accordingly, it is an object of the invention to provide an apparatus for applying heat at a requisite temperature and applying a requisite amount of pressure to a transfer and garment for a requisite amount of time.

Another object of the invention is to provide such an apparatus which will automatically cease applying heat and pressure after a requisite amount of time in such a manner so as not to smear or lift the transferred design from the garment.

It is an additional object of the invention to provide heat uniformly to the transfer and garment.

It is an additional object of the invention to apply pressure uniformly over the garment even if there are minor localized bulges in the garment.

It is an additional object of the invention to provide a heat transfer machine having a pair of platens and a timer, which upon automatic disengagement of the platens after a pre-selected amount of time automatically resets the timer to the pre-selected time.

Other further objectives and advantages of the invention will be described in the discussion which follows taken together with the accompanying drawings.

As previously indicated, this invention is particularly suited for the application of designs or transfers comprised of thermosetting inks to fabrics and garments. These designs are commonly available secured to a carrier material. For purposes of the present disclosure, the term "thermosetting ink" refers to all such inks which may be applied to fabrics from a carrier material through the application of heat and pressure. Strictly speaking, thermosetting inks are inks which undergo a chemical change at approximately 350° F, thus curing or setting them; subsequent applications of heat and pressure after the setting will not cause the inks to flow. As used herein, the term "thermosetting ink" includes thermoplastic inks and other like inks in accordance with the definition set forth herein.

The apparatus of the present invention is a heat transfer machine or press which includes a pair of engageable platens. The lower platen is spring mounted to a frame, while the upper platen is spring mounted to an arm which is pivotally connected to the frame. Each platen is covered with silicone foam rubber pads, which are in turn covered by a sheet of tefloncoated fiberglas. The floating or spring mounted platens insure uniformity of pressure between the platens when they are engaged. The resiliency of the silicone foam rubber pads assures this uniformity of pressure even when there are localized bulges in the garment being placed between the platens.

Connected to the upper platen are electrical heating elements and an adjustable thermostat for selection of the desired temperature. The heating elements are sandwiched between the platen and insulation to minimize heat loss and thus increase operating efficiency. The operating efficiency is increased by the insulation in a dual manner. The device thus uses less electricity than it otherwise would, thus saving on the cost of electricity. In operation heat is lost due to the transfer of heat to the garment, thus lowering the temperature of the upper platen. The insulation enables the upper platen to be quickly brought back to its operating temperature, thus minimizing the delay between successive operations of the device thereby increasing its output. This delay is additionally minimized through the use of heat sinks and a large platen which itself acts as a heat sink. By minimizing this delay, the machine is utilized more efficiently.

The platens of the invention have three primary positions, a fully open position, a fully engaged or closed position, and a partially open position. When the requisite pressure has been applied at the proper temperature for a requisite pre-selected amount of time, the device automatically goes from the fully engaged position to the partially open position. This is done in a slow and uniform manner for the reasons previously described.

The invention includes a timer which is, of course, used in automatically disengaging the platens. To enable more efficient use of the device, the timer automatically resets itself to the original pre-selected time upon automatic disengagement of the platens. This, of course, avoids the necessity of the operator resetting the timer prior to each use. Thus the timer need not be varied unless it is desired to change the amount of time during which heat and pressure are applied.

DESCRIPTION OF THE PREFERRED EMBODIMENT

Figure 1:
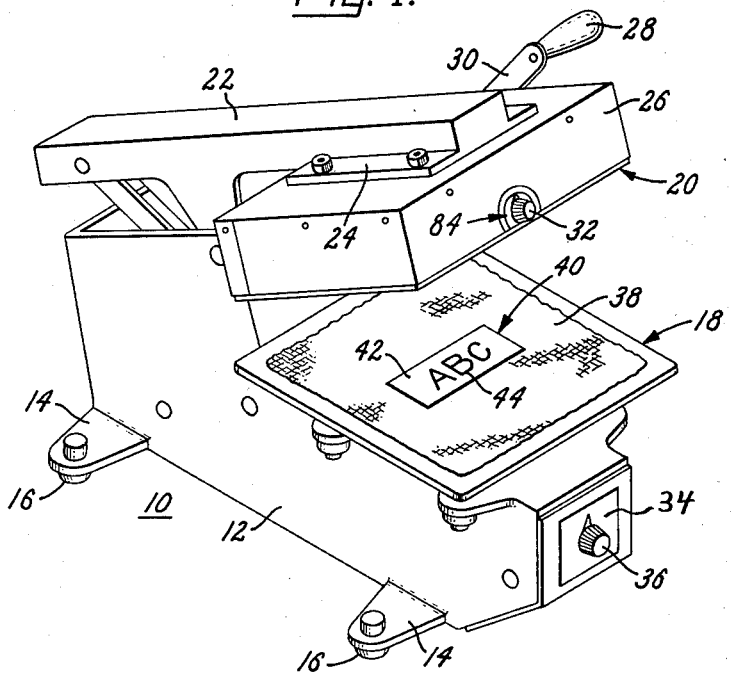
FIG. 1 is a perspective view of the present invention in its fully open position and showing a fabric and transfer properly positioned on the lower platen.

The apparatus or heat transfer machine of the present invention 10 is shown in FIG. 1. The machine includes a frame or housing 12 supported by legs 14. Connected to each of the four legs are resilient rubber pads 16 which prevent the machine from sliding and marring or scratching the surface upon which the machine is placed. A lower platen assembly 18 is shown mounted to the frame 12. The upper platen assembly 20 is shown mounted to an arm 22, having flanges 24. A box assembly or guard 26 is shown partially enclosing the upper platen assembly 20. The guard is a safety device to prevent the operator of the machine from becoming injured by the hot upper platen. The guard is also connected to the arm 22. The arm 22 is pivotally connected to the housing 12. Also shown is a handle 28 connected to a lever 30. Movement of the lever via the handle causes the upper and lower platens to engage. A knob 32 is shown for selecting the requisite temperature. A timer 34, having a knob 36, is shown for selecting the requisite time. A piece of fabric 38 is shown positioned on the lower platen assembly 18. This fabric is meant to be representative of any garment which may be placed on this machine, e.g., a T-shirt or sweat shirt. An applique 40 is shown properly positioned on the fabric. The applique 40 includes a carrier material 42 and a transfer or design in thermosetting inks 44. For purposes of description, the carrier 42 has been drawn transparent so that the design 44, which is affixed to the underside of the carrier and is in contact with the fabric 38, may be seen.

For most garments upon which this type of transfer will be used, a pressure of at least 0.75 pounds per square inch must be applied. In the present embodiment of the invention a pressure of approximately 2 pounds per square inch is used. The upper platen assembly is maintained at a temperature of approximately 380° F. This temperature is particularly wellsuited for thermosetting inks when applied to cotton fabrics. The desired temperature may vary with other fabrics. The garment and transfer should be compressed for approximately 10 seconds at a pressure of 2 pounds per square inch. The greater the pressure, the less time the pressure need be applied. At the end of 10 seconds, the thermosetting ink is still in a fluid or semi-fluid state. Therefore, the platens must be disengaged and the pressure relieved relatively slowly so as to preserve the integrity of the design. An abrupt or rapid disengagement of the platens may result in smearing and lifting of the design from the fabric.

A relatively slow and partial disengagement of the platens eliminates the application of pressure and substantially reduces the amount of heat passed to the garment and transfer notwithstanding the fact that the platen remains substantially at its preset temperature. In this condition the temperature of the garment and transfer is permitted to drop, thus completing the setting of the inks which comprises the design.

Improper temperature, pressure or duration of application of the proper temperature and pressure may also have undesirable consequences. The inks may not properly flow into the fabric, resulting in a design which may not properly adhere to the fabric. A design may become disengaged by inadvertently peeling or during laundering. Application of heat and pressure for too long a duration may result in excessive flowing of the ink, resulting in a fuzzy design. Thus, it may be seen that the proper conditions are important in securing the design to the fabric for durable, long-lasting results.

The manner in which the platens apply pressure uniformly will now be described with reference to FIGS. 2, 3 and 6. As may best be seen in FIGS. 2 and 3, the lower platen assembly 18 is connected to flanges 45 of the frame 12 at four locations. At each of the locations a bolt 46 is secured or screwed into a metal plate 48 which comprises the lower platen assembly. The bolt 46 is secured to the plate 48 by locknut 50. A spring 52 encompasses the bolt 46. One end of the spring 52 abuts the flange 45, while the other end abuts the locknut 50. The bolt 46 is free to slide through a hole, not shown, in the flange 45. The bolt 46 is slideably secured to the flange 45 by a nut 54. A resilient pad 56, made of a rubber-like material, is interposed between the flange 45 and the nut 54 to aid in the gradual reduction of pressure when the platens are disengaged. The lower side of the pad 56 is supported by a washer 58, which is interposed between it and the nut 54. The pressure exerted by the platens in their fully engaged position may be adjusted by varying the position of nut 54 on the bolt 46, thus adjusting the force exerted by the spring 52.

The upper platen is similarly supported or connected to the arm 22. The connection of the upper platen to the arm may best be seen in FIG. 2. The upper platen assembly is supported by four bolts 60 which are slideably connected to holes, not shown, in flanges 24 of the arm 22. Nuts 62 prevent the bolts from sliding through the holes in the flanges. A washer 64 is interposed between the nut 62 and flange 24. Springs 66 encompass the bolt 60. The upper portion of the springs 66 abut against the top of the box assembly 26, which in turn abuts the flanges 24 of the arm 22. The lower portion of the springs 66 abut against the nut 68.

Figure 6:
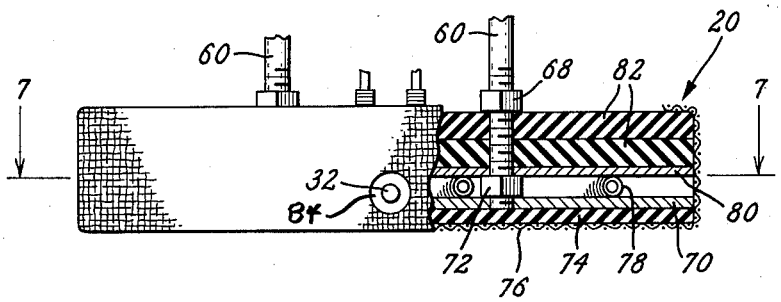
FIG. 6 is a front elevation view, partially broken away, of the upper platen.

Attachment of the bolt 60 to the upper platen assembly 20 will now be shown with reference to FIG. 6. As just indicated, the spring 66, not shown in this view, abuts nut 68. The bolt 60 threadably engages the plate 70 which comprises the upper platen assembly 20 and is locked thereto by nut 72.

The pressure exerted by the platens may also be adjusted by varying the position of the nut 62 on the bolt 60, thus adjusting the force exerted by the spring 66. The upper and lower platen assemblies 20 and 18 are thus supported in a manner which assures substantial uniformity of pressure distribution when they are engaged. Any misalignment between the two platens is inherently compensated for, due to the floating or spring-mounting of the platens. Thus uniformity of pressure distribution is assured even if misalignment does occur as by the insertion between the platens of a garment having a thickness differential.

The upper and lower platen assemblies are also designed to compensate for minor localized bulges which may occur in the garments which are inserted therebetween. Uniformity of pressure distribution is assured through the use of silicone foam rubber pads which are placed adjacent to the plates 48 and 70 which comprise the lower and upper platens. These pads are in turn covered and secured to the plates by a Teflon-coated fiberglas covering 76. In normal use of the present invention, the pressure between the upper and lower platen assemblies may be varied by inserting additional foam rubber pads 74. In the preferred embodiment of the invention, ⅛ inch thick pads are used. The addition of one pad will increase the pressure between the platens by approximately 0.4 of a pound per square inch.

Only the upper platen assembly of the present invention contains heating elements. Heat need only be applied to the applique 40, which is placed upon the fabric 38, resting on the lower platen 18. Thus, the upper platen abuts the applique 40, as is required. Heating the upper platen, as opposed to the lower platen, is advantageous as it facilitates the proper placement of the transfer 44 on the fabric.

Figure 7:
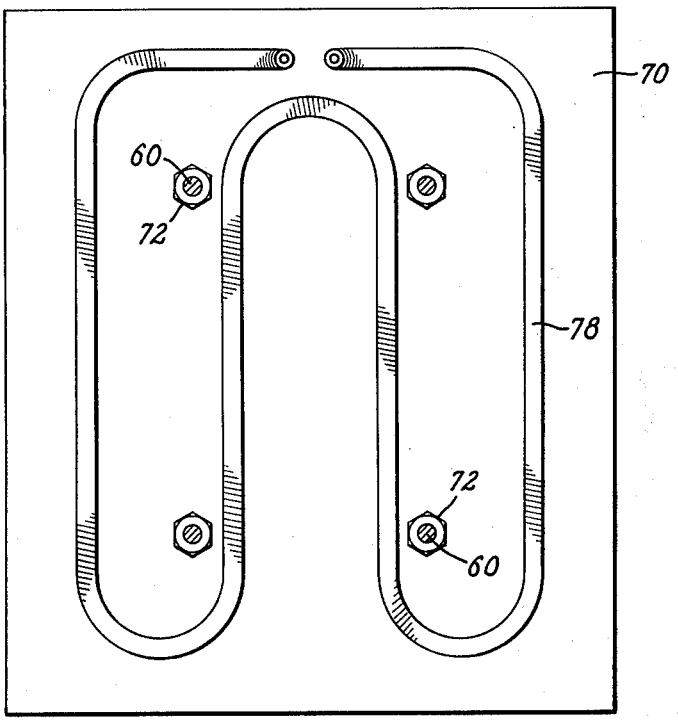
FIG. 7 is a top elevation view taken along line 7—7 in FIG. 6, showing a heating element.

Referring now to FIGS. 6 and 7, a serpentine heating element 78 is shown abutting the upper platen plate 70 and a contact plate 80.

In order to prevent heat loss and conserve energy, two sheets of insulation 82 are used. A conventional thermostat 84, having a knob 32, is used to control the temperature of the upper platen. A thermofuse, not shown, insures that excessive temperatures are not reached inadvertently.

Engagement and disengagement of the upper and lower platen assemblies will not be described with reference to FIGS. 3, 4 and 5. The arm 22 is pivotally connected to the frame 12 at point 86 by suitable means. Rotation of the arm 22 about point 86 brings the upper platen assembly 20 into engagement with the lower platen assembly 18. When the arm 22 is fully raised, face 88 on the rearward portion of the arm abuts against the stop or bolt 90, which threadably engages the frame 12. The bolt 90 is secured by locknut 92. The maximum range of rotation of the arm 22 can be adjusted by varying the position of bolt 90.

Figure 3:
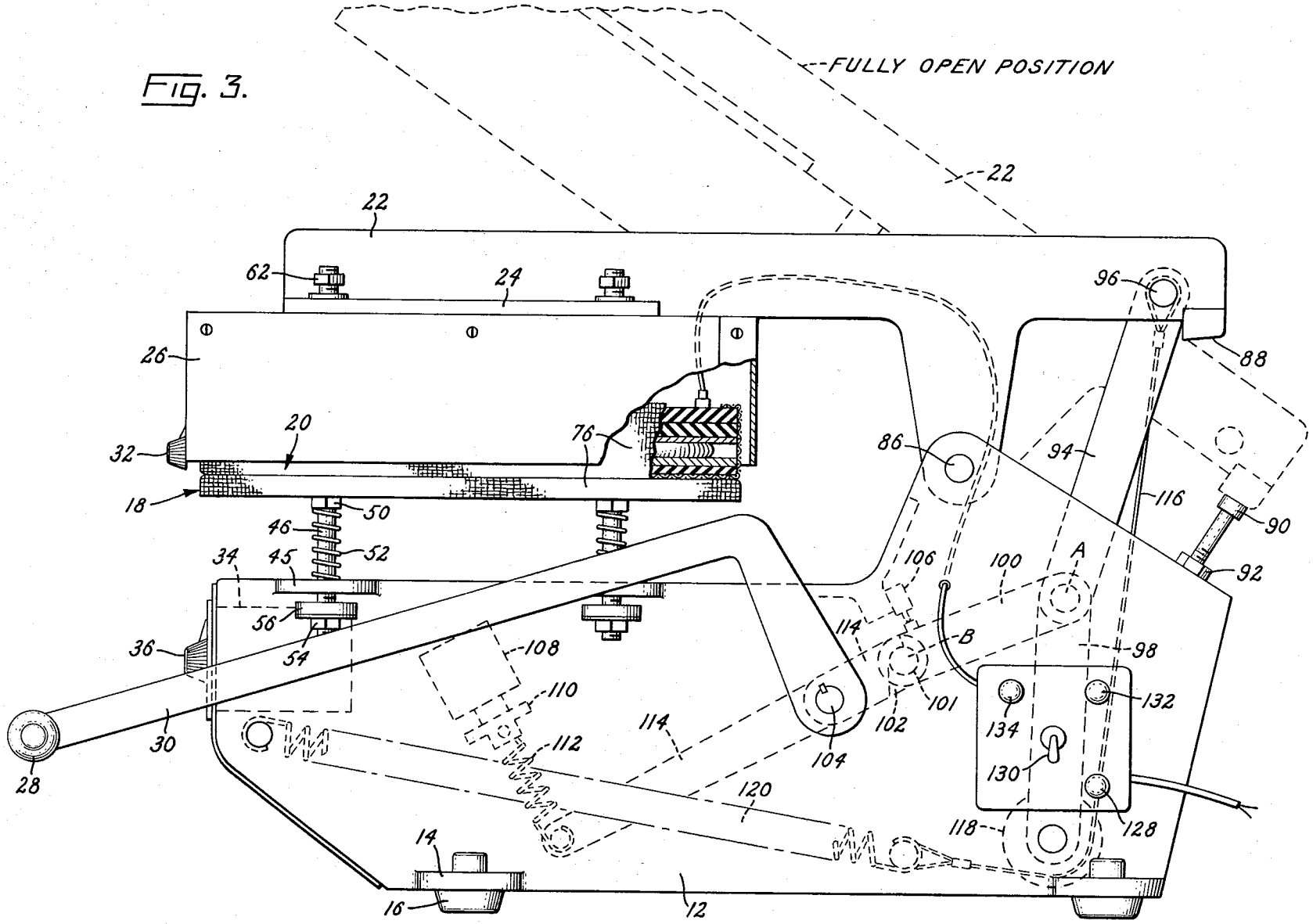
FIG. 3 is a side elevation view, partially broken away, showing the present invention in its fully closed position and showing the upper platen in phantom in its fully open position.

FIG. 3 shows the apparatus of the present invention in its fully closed position. This is the position the device is in while heat and pressure are being applied to the garment and applique. A link 94 is shown pivotally connected to the arm 22 at point 96. The remaining end of link 94 is pivotally connected to a link 98 at a point A. The remaining end of link 98 is pivotally connected to the frame 12. A link 100 is pivotally connected to links 94 and 98 at point A. The remaining end of link 100 is connected to a link 102 at a point B by a rod 101. The remaining end of link 102 is rigidly connected to a rotatable rod 104, which passes through holes in the frame 12 and is secured by suitable means, against lateral movement with respect to the frame. The lever 30, having the handle 28 connected to it, is rigidly connected to rod 104.

The linkages and connecting mechanisms between the upper platen assembly and the handle 28 have been designed so as to provide a mechanical advantage of 20 to 1, i.e., 1 pound force exerted on the handle will result in 20 pounds of force being exerted on the upper platen. In the preferred embodiment of the invention the surface area of the platens is approximately 200 square inches. Accordingly, a 20 pound force on the handle will yield 400 pounds force on the upper platen or a pressure between the plates of 2 pounds per square inch in the preferred embodiment.

Figure 2:
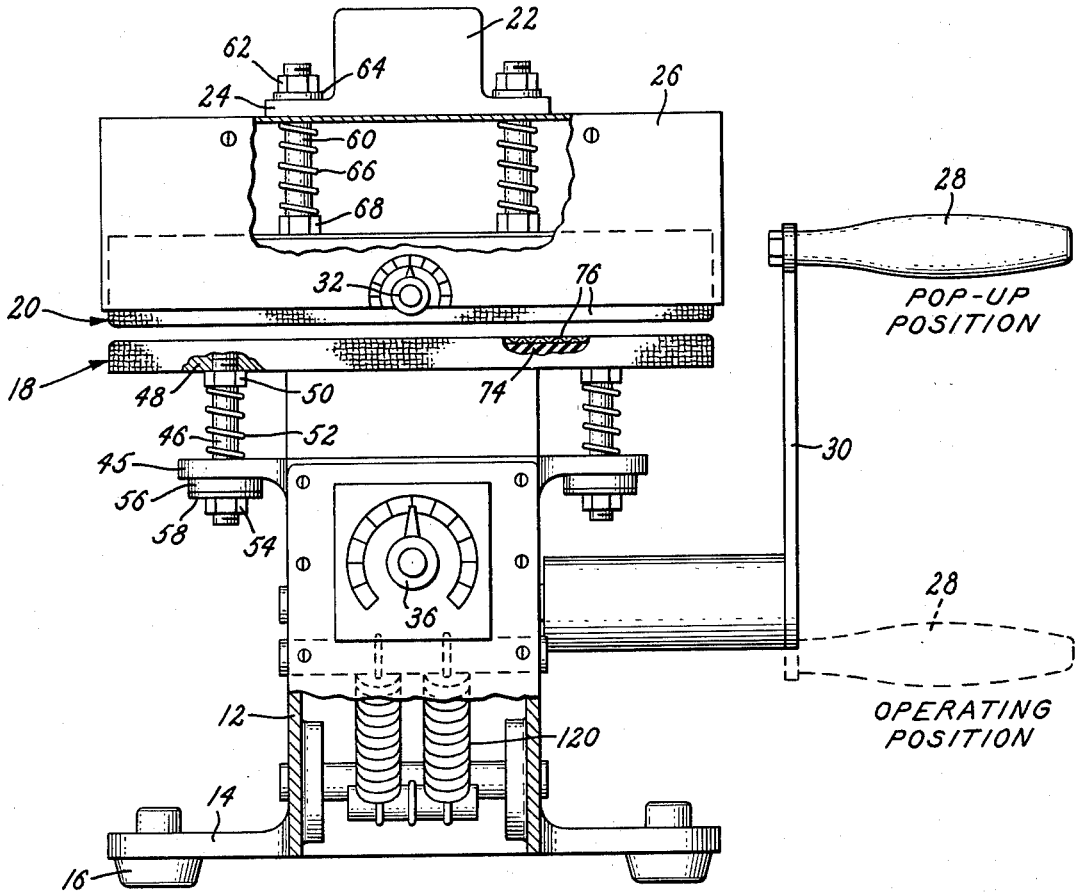
FIG. 2 is a front elevation view, partially broken away, of the present invention in its partially open position.
Figure 4:
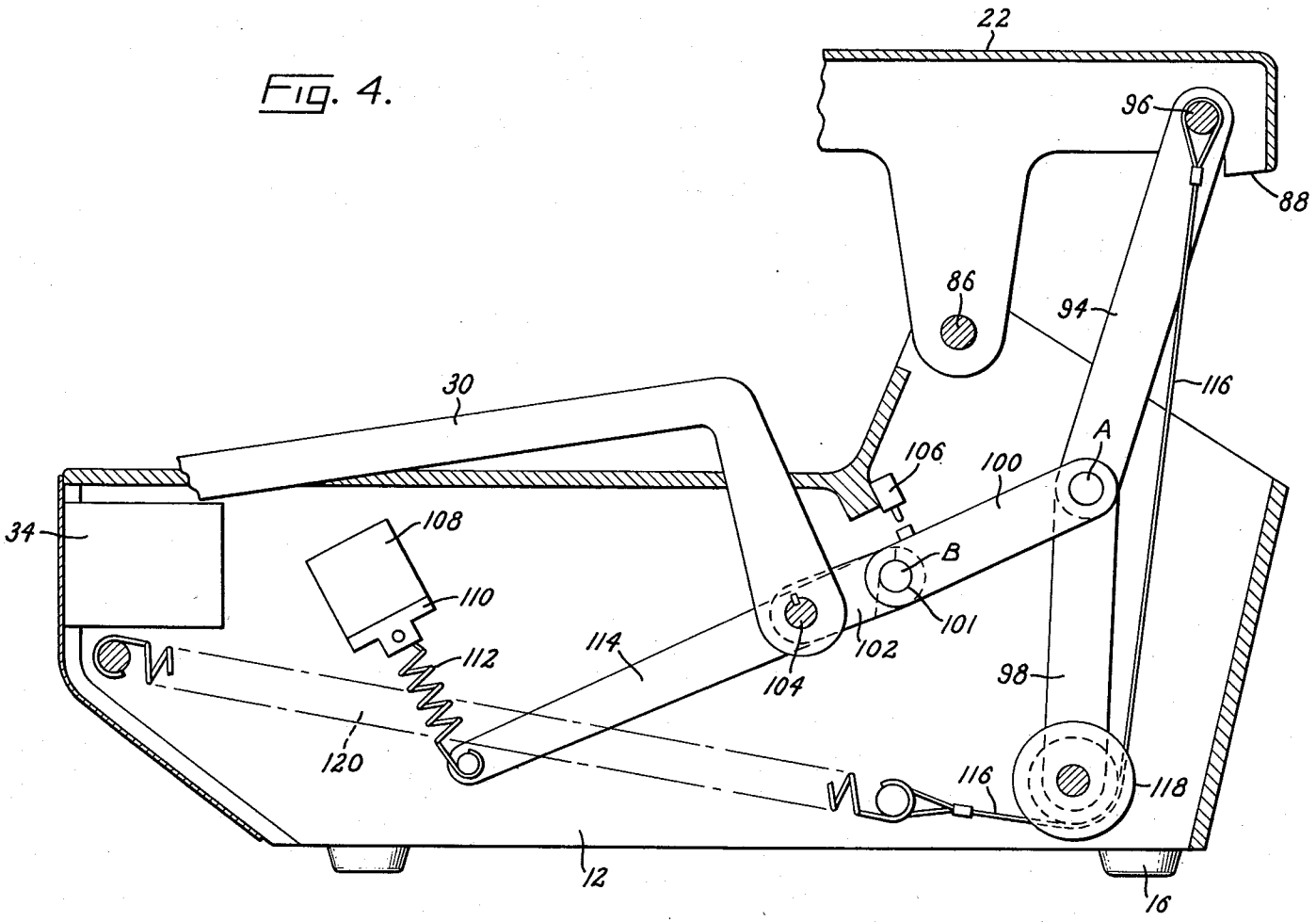
FIG. 4 is a partial side elevation view, broken away, of the present invention in its partially open position.
Figure 5:
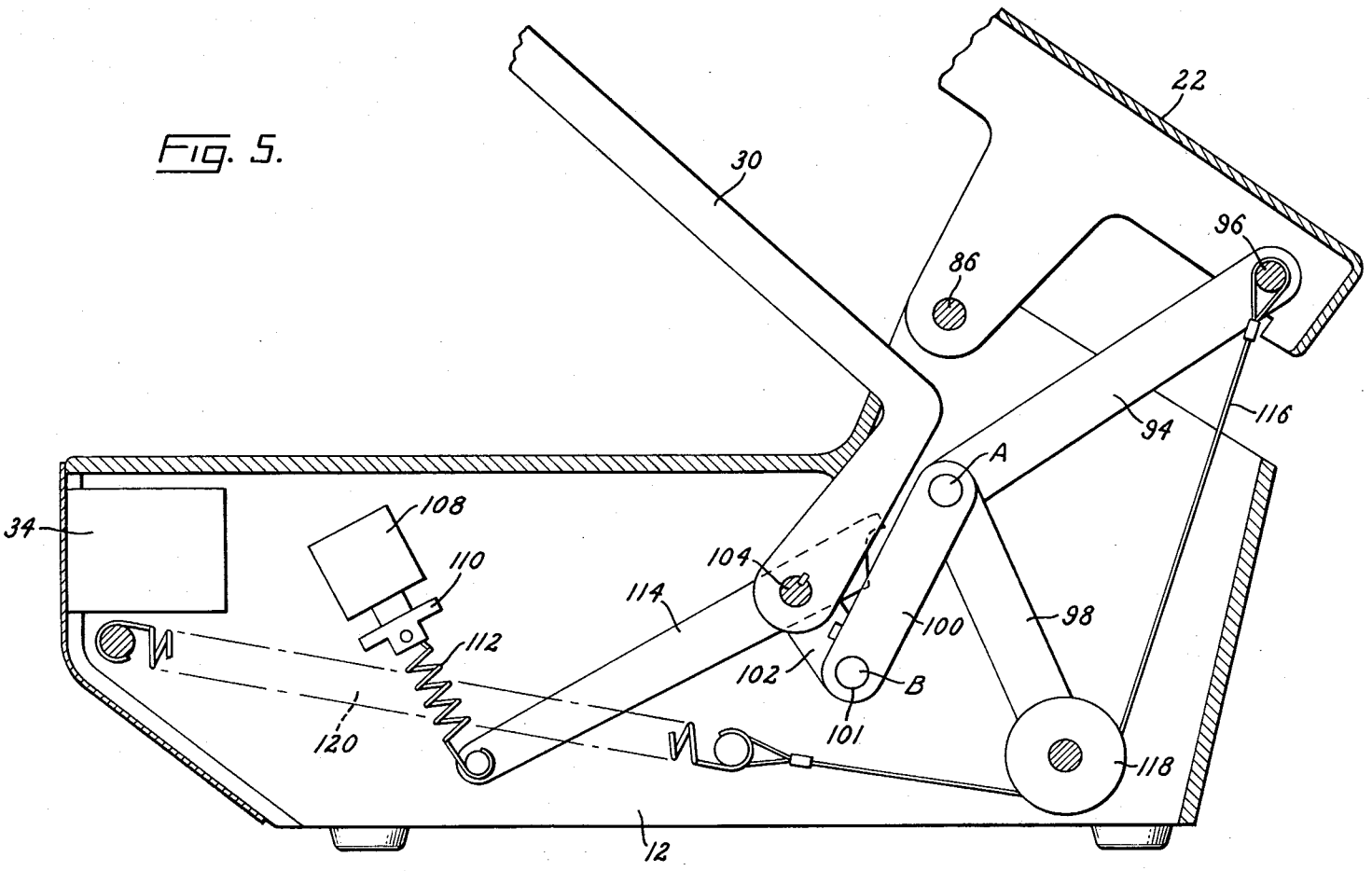
FIG. 5 is a partial side elevation view, broken away, of the present invention in its fully open position.

Movement of the linkages in raising the upper platen from the fully engaged position, as shown in FIG. 3, to the partially open position, as shown in FIGS. 2 and 4, will now be described. The handle 28 may be manually raised or the upper platen may be raised automatically as will hereinafter be described. In any case the handle will move from the position shown in FIG. 3 and shown in phantom in FIG. 2 to the position shown in FIGS. 2 and 4. Raising of the handle causes rotation of lever 30 and hence rotation of link 102, thereby shifting point B, the juncture of links 102 and 100 downward. This shifts the position of link 100, thereby causing point A to move downward and toward the front of the invention. This forces link 94 to move downward, thereby causing rotation of the arm 22 and the raising of the upper platen assembly 20.

The upper platen may be raised to its fully open position as shown in phantom in FIG. 3 by raising the handle 28 until the rear portion of the arm moves sufficiently to cause face 88 to abut the stop 90. This action causes the linkages to move in the same manner which was previously described, thus moving the upper platen from the partially open position to the fully open position. The position of the links are shown in FIG. 5.

In bringing the invention from its fully open position to the fully engaged position, the linkages move in the reverse order from that just described.

The position of the platens in the partially open position places them at an angle, with respect to each other, within 2° to 10°.

The weight of the upper platen assembly and arm 22 is positioned substantially ahead of the pivot point 86. In order to more easily rotate this combination about the pivot point 86, the arm 22 is spring loaded. Spring loading was used to achieve this purpose in lieu of a counterweight in order to reduce the weight of the device. Referring now to FIG. 3, a cable 116 is shown connected to the arm 22 at poing 96. The cable 116 wraps around a pulley 118, which is rotatably connected to the frame 12 at the same point at which link 98 is connected to the frame. The remaining end of the cable 116 is connected to a spring 120, which is connected to the frame 12.

The manner in which the device is automatically repositioned from the fully engaged position to the partially open position will now be described with reference to FIG. 3. Prior to fully engaging the device with the garment and transfer placed between the platens, the timer 34 is set to the desired time, e.g., 10 seconds, by appropriately adjusting knob 36. Upon manually depressing handle 28, fully engaging the platens, link 100 activates an electrical switch 106, thereby starting the timer 34. Subsequent to the passing of the pre-selected amount of time, in this case 10 seconds, the timer activates a solenoid 108. The solenoid 108 has a plunger 110 which is normally extended when the platens are fully engaged, as is shown in phantom FIG. 3. Upon activation of the solenoid 108 the plunger 110 retracts into the solenoid, as shown in FIG. 4. The retraction of plunger 110 exerts tension on a spring 112, thereby rotating a link 114 about rod 104 which it is pivotally connected to. Rotation of link 114 in this manner causes it to abut rod 101, thereby shifting point B downward and rearward. As previously described, this causes the links to move in a manner which causes the platens to disengage. By appropriately designing the lengths of the links, this will result in the upper platen assuming a position of two to ten degrees with respect to the lower platen. The spring 112 is used to connect the link 114 to the solenoid plunger 110, in lieu of connecting it rigidly to link 114, so that the disengagement of the platens is not abrupt and rapid. As has been previously referred to, this is important so as not to damage the design or transfer.

Figure 8:
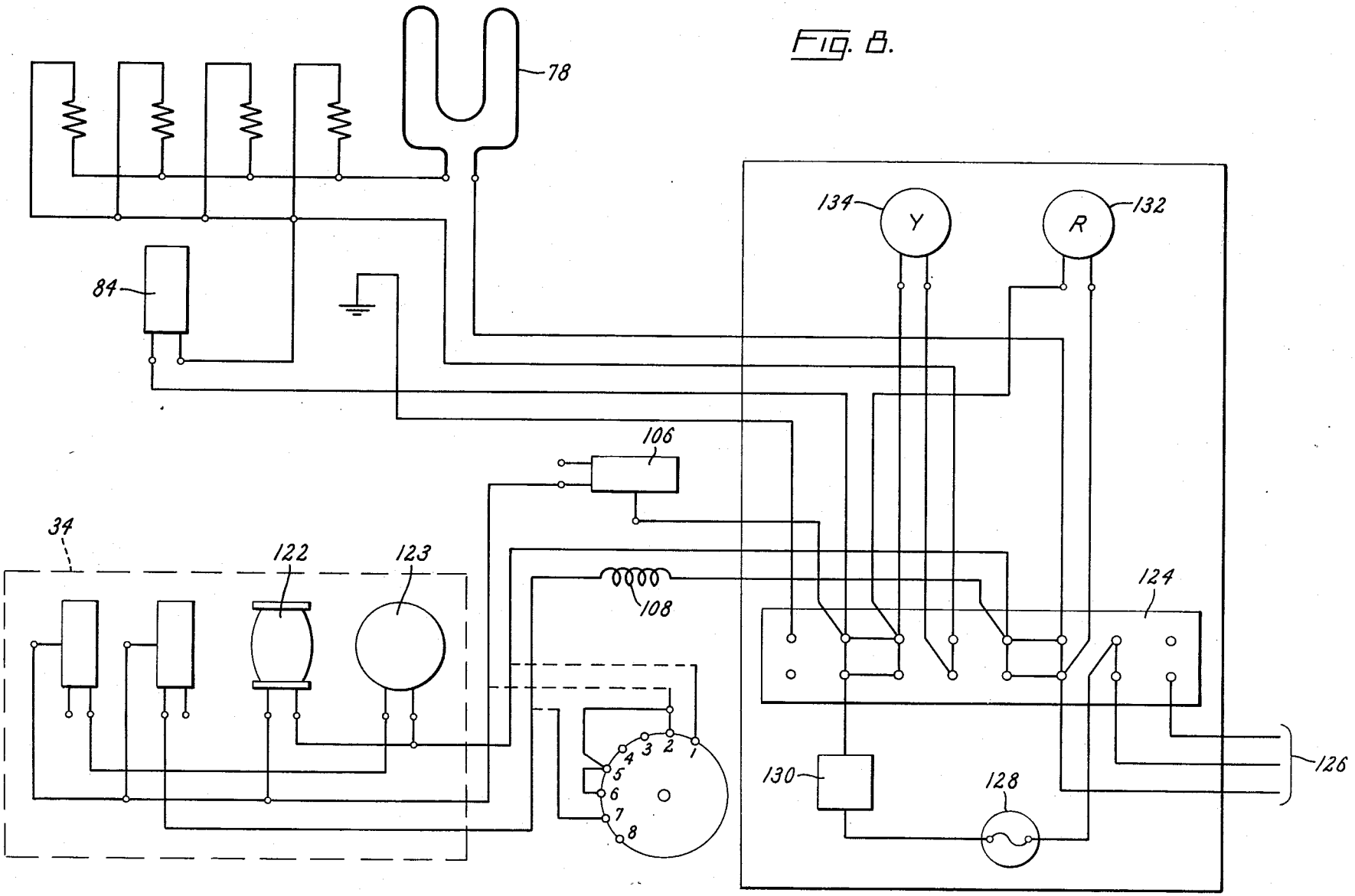
FIG. 8 is a schematic drawing of the electrical system of the present invention.

Upon assuming the partially open position, the timer 34 automatically resets itself to its originally set time, i.e., 10 seconds. Referring now to FIGS. 3 and 8, it may be seen that when the platens assume the partially open position, the link 100 disengages the switch 106. This causes a solenoid 122 within the timer to reposition it, and the knob 36 to the original pre-selected time. Of course, fully closing the platens by fully depressing the handle 28 reengages the switch 106, repeating the process. Thus, it may be seen that for the repetitive application of transfers to like fabrics, the timer need not be manually reset prior to each use of the invention.

A brief description of the electrical system of the present invention will be made with reference to FIG. 8. The timer 34, with its solenoid 122 and its motor 123, is shown connected to the solenoid 108 and a switch 106, which are in turn connected to the buss bar 124. The buss bar is connected to an external power source. The power line 126 is connected in series with a fuse 128 and a switch 130. Upon actuation of the switch 130, a red light 132 is activated, indicating that the power is on. A yellow light 134 is connected to the thermostat so that it is activated when the selected temperature has been reached, thus indicating to the operator that the machine is available for use.

Prior to operation of the machine, the operator would activate switch 130 and select the desired temperature by setting the thermostat knob 32. Upon activation of the yellow light, the operator would set the timer for the particular time required for the ink and fabric being used. The garment would be placed on the lower platen and the carrier material with the transfer thereon would be placed face down upon the fabric. The handle would be manually lowered, thus fully engaging the platens. This would engage the microswitch 106, which would activate the timer motor 123. At the termination of the pre-selected amount of time, the timer would activate the solenoid 108, thus causing the platens to disengage to the partially open position. Upon disengagement of the platens, the timer solenoid 122 would automatically reset the timer to its originally preselected position. The operator would then manually raise the upper platen to its fully open position and carefully remove the carrier material from the fabric. Upon removal of the fabric from the lower platen, the machine is again available for use with a similar fabric and ink.

Thus, it has been shown that a machine has been provided which is ideally suited for the application of designs or transfers to garments, particularly in that the machine so provided assures uniformity of pressure distribution by providing a pair of floating platens and by providing platens which provide uniformity of pressure distribution even though there may be minor bulges or thickness variations in the garment or fabric. Additionally, the machine provides the appropriate magnitude of temperature and pressure for a desired amount of time in a manner which enables efficient utilization of the machine.

Although the present invention has been shown with reference to a particular embodiment, it is to be understood that the invention may be used with various changes in modification without departing from the spirit thereof.

What is claimed is:

1. An apparatus for applying designs comprised of thermosetting ink from a carrier material to a fabric which comprises:

a frame;

a lower platen connected to said frame by means for permitting the variation of the vertical and angular position between said platen and said frame;

an upper platen, including means for heating said upper platen to a particular temperature, connected to an arm by means for permitting the variation of the vertical and angular position between said platen and said arm when said arm is substantially horizontal, said arm being pivotally connected to said frame at a point spaced between its opposite ends; and actuation means pivotally connected to said arm and to said frame for compressing said upper platen against said lower platen to a fully engaged position said actuation means including;

a manually operative member, operation of which causes said upper platen to change its position with respect to said lower platen;

a timer having a range of settings which may be set at a pre-selected time within the range; and an automatic means acting in response to the timer for partially moving said upper platen with respect to said lower platen to a partially open position in between said fully engaged position and a fully open position when the pre-selected time has passed, thereby permitting disengagement of said platens at said pre-selected time in such a manner so as to avoid smearing of said thermosetting inks of said fabric;

thereby providing an apparatus for applying heat and pressure to the fabric, design and its carrier material placed therebetween, and moving said upper platen away from said lower platen to said fully open position, and positions therebetween including said partially open position.

2. The apparatus of claim 1 wherein said actuation means further includes:

a first link, one end of which is pivotally connected to said arm;

a second link pivotally connected at one end to the remaining end of said first link at a point A, the remaining end of said second link being pivotally connected to said frame;

a third link having one end thereof pivotally connected to said first and second links at point A; and a fourth link, one end thereof pivotally connected to the remaining end of said third link by a pivot means at a point B, the remaining end thereof being pivotally connected to said frame and rigidly connected to said manually operative member whereby, when the upper platen is in its fully open position, lowering of the manually operative member causes rotation of said fourth link thereby repositioning point B, thus increasing the distance between point A and the point at which said fourth member is pivotally connected to said frame, thus repositioning point A so as to increase the distance between the point at which said first link is pivotally connected to said arm and the point at which said second link is pivotally connected to said frame, thereby causing said arm to rotate about the point at which it is pivotally connected to said frame, thus bringing the upper platen into forced contact with said lower platen.

3. The apparatus of claim 2, wherein said means for partially moving said upper platen with respect to said lower platen when the pre-selected time has passed, which comprises:

a fifth link pivotally connected, at a point between its opposite ends, to said frame at the point at which said fourth link is pivotally connected to said frame, one end of said fifth link being positioned adjacent to said pivot means;

a solenoid connected to said frame, operatively connected to said timer, having an extendible member; and a spring connected at one end to said extendible member and connected at its opposite end to the remaining end of said fifth link, whereby actuation of said solenoid by said timer causes movement of said spring thereby causing rotation of said fifth member, which in turn causes the opposite end of said fifth link to come into contact with said pivot means, thereby causing point B to move downward and rearward, thus causing the platens to reposition to the partially open position.

4. The apparatus of claim 3, which further includes a switch connected to said frame so that said switch is activated when said platens are fully engaged and is de-activated when said platens are in the partially open position, said switch being operatively connected to said timer so that the pre-selected amount of time commences when said switch is activated; and wherein said timer includes means for automatically resetting said timer to its original pre-selected position when said switch is de-activated when said platens assume their partially open position.

5. The apparatus of claim 4 wherein said upper and lower platens each include resilient members, thus permitting a uniform pressure distribution across fabrics having bulges which are placed between said platens.

6. The apparatus of claim 1 wherein said means for permitting the variation of the vertical and angular position of said lower platen with respect to said frame includes:

a plurality of bolts, one end of each of which threadably engage said platen, said bolts being slidably connected to said frame, each of said bolts being encompassed by a helical spring, one end of which abuts said platen, the other end of which abuts said frame, thus preventing said platen from abutting said frame, thereby permitting said platen to vary its vertical and angular position with respect to said frame and providing uniform pressure distribution between said platens when they are fully engaged.

7. The apparatus of claim 1 wherein said means for permitting the variation of the vertical and angular position of said upper platen with respect to said arm includes:

a plurality of bolts, one end of each of which threadably engage said platen, said bolts being slidably connected to said arm, each of said bolts being encompassed by a helical spring, one end of which abuts said platen, the other end of which abuts said arm, thus preventing said platen from abutting said arm, thereby permitting said platen to vary its vertical and angular position with respect to said arm and providing uniform pressure distribution between said platens when they are fully engaged.

8. The apparatus of claim 1 wherein said means for permitting the variation of vertical and angular position of said lower platen with respect to said frame further includes means for controlling the maximum distance said platen may be displaced from said frame, thus enabling the amount of pressure exerted between said platens when they are in their fully engaged position to be varied.

9. The apparatus of claim 2 which further includes means for counteracting the uneven distribution of weight about the pivot point of said arm.

10. The apparatus of claim 9 wherein said means for counteracting the uneven weight distribution about said arm comprises:

a cable connected to said arm at the pivot point of said first link and said arm;

a pulley rotatably connected to the pivot point of said frame and said second link, said cable passing about said pulley; and a spring, one end of which is connected to the remaining end of said cable, the remaining end of said spring being connected to said frame.

* * * * *